US011099497B2

(12) United States Patent
Hashimoto et al.

(10) Patent No.: US 11,099,497 B2
(45) Date of Patent: Aug. 24, 2021

(54) IMAGE FORMING APPARATUS THAT CONTROLS IMAGE FORMATION ACCORDING TO A PROPERTY OF A RECORDING MATERIAL

(71) Applicant: CANON KABUSHIKI KAISHA, Tokyo (JP)

(72) Inventors: Tomohiro Hashimoto, Abiko (JP); Tsutomu Ishida, Suntou-gun (JP); Masafumi Monde, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/548,186

(22) Filed: Aug. 22, 2019

(65) Prior Publication Data

US 2019/0377280 A1 Dec. 12, 2019

Related U.S. Application Data

(63) Continuation of application No. 15/360,804, filed on Nov. 23, 2016, now Pat. No. 10,416,590.

(30) Foreign Application Priority Data

Nov. 30, 2015 (JP) ..... 2015-234285

(51) Int. Cl.
*G03G 15/043* (2006.01)
*G03G 15/00* (2006.01)

(52) U.S. Cl.
CPC ..... *G03G 15/043* (2013.01); *G03G 15/5029* (2013.01); *G03G 15/6591* (2013.01); *G03G 2215/00945* (2013.01); *G03G 2215/2045* (2013.01)

(58) Field of Classification Search
CPC ..... G03G 15/6591
See application file for complete search history.

(56) References Cited

U.S. PATENT DOCUMENTS

2008/0175606 A1* 7/2008 Okada ..... H04N 1/2323 399/15
2014/0056630 A1* 2/2014 Kanno ..... G03G 15/50 399/396

FOREIGN PATENT DOCUMENTS

JP 2013179532 A * 9/2013

OTHER PUBLICATIONS

JP-2013179532-A, Machine Translation, Komiya, Japan, 2013.*

* cited by examiner

*Primary Examiner* — Victor Verbitsky
(74) *Attorney, Agent, or Firm* — Canon U.S.A., Inc. I.P. Division

(57) ABSTRACT

An image forming apparatus includes a conveyance unit, an irradiation unit, an image capturing unit configured to capture a plurality of times the light radiated by the irradiation unit and reflected on the recording material as surface images, an image formation unit, and a control unit, wherein the conveyance unit accelerates or decelerates a conveyance speed of the recording material in at least a part of an image capturing period during which the image capturing unit captures the surface images the plurality of times, and wherein the control unit obtains a feature quantity from a plurality of surface images captured by the image capturing unit and controls the image forming condition based on the obtained feature quantity and a threshold value set according to the conveyance speed of the recording material in the image capturing period.

26 Claims, 11 Drawing Sheets

FIG. 9

| DETERMINATION THRESHOLD VALUE / CONVEYANCE SPEED RATIO | FIRST THRESHOLD VALUE | SECOND THRESHOLD VALUE |
|---|---|---|
| 0.5 | 890000 | 570000 |
| 0.6 | 856000 | 536000 |
| 0.7 | 822000 | 502000 |
| 0.8 | 788000 | 468000 |
| 0.9 | 754000 | 434000 |
| 1.0 | 720000 | 400000 |
| 1.1 | 686000 | 366000 |
| 1.2 | 652000 | 332000 |
| 1.3 | 618000 | 298000 |
| 1.4 | 584000 | 264000 |
| 1.5 | 550000 | 230000 |
| 1.6 | 516000 | 196000 |
| 1.7 | 482000 | 162000 |
| 1.8 | 448000 | 128000 |
| 1.9 | 414000 | 94000 |
| 2.0 | 380000 | 60000 |

IMAGE FORMING APPARATUS THAT CONTROLS IMAGE FORMATION ACCORDING TO A PROPERTY OF A RECORDING MATERIAL

CROSS REFERENCE TO RELATED APPLICATIONS

The present application is a continuation of U.S. patent application Ser. No. 15/360,804, filed on Nov. 23, 2016, which claims priority from Japanese Patent Application No. 2015-234285 filed Nov. 30, 2015, which is hereby incorporated by reference herein in its entirety.

BACKGROUND

Technical Field

The present invention relates to an image forming apparatus configured to control an image forming condition according to a surface property of a recording material.

Description of the Related Art

Conventionally, an image forming apparatus such as a copying machine or a printer, which includes a sensor for determining a type of a recording material, has been provided. Such an image forming apparatus automatically determines a type of a recording material and controls a transfer condition (e.g., a transfer voltage and/or a conveyance speed of a recording material in a transfer period) and a fixing condition (e.g., a fixing temperature and/or a conveyance speed of a recording material in a fixing period) according to the determination result.

An image forming apparatus discussed in Japanese Patent Application Laid-Open No. 2010-283670 emits light to a recording material being conveyed at a constant speed and captures light reflected on the recording material as an image through a complementary metal oxide semiconductor (CMOS) line sensor. Then, the image forming apparatus determines a type of the recording material based on the captured image and controls the image forming condition. With this configuration, a high-quality image can be formed on the recording material.

An image forming apparatus discussed in Japanese Patent Application Laid-Open No. 2013-179532 determines whether there is a breakage or a hole on a recording material by detecting a surface state of the recording material being conveyed therethrough. According to the technique discussed in Japanese Patent Application Laid-Open No. 2013-179532, when a speed of the recording material is accelerated or decelerated, an amount of irradiation light or a reading speed, i.e., a so-called shutter speed, is adjusted according to the speed of the recording material. With this configuration, a surface state of the recording material can be detected with a brightness and/or resolution similar to those of the case where the recording material is conveyed at a constant speed.

However, adjusting the reading speed on a real time basis according to the conveyance speed of the recording material, and finely adjusting the amount of irradiation light as discussed in Japanese Patent Application Laid-Open No. 2013-179532, complicates the operation for detecting the surface state of the recording material. Further, in consideration of the responsiveness of the normally-used light-emitting diode (LED), it can be difficult to make the amount of irradiation light accurately follow the change of the conveyance speed of the recording material.

SUMMARY

Various embodiments of the present application are directed to an image forming apparatus capable of forming an image of high quality by determining an image forming condition according to a surface state of a recording material without executing a complicated detection operation even in a case where a speed of the recording material is accelerated or decelerated.

According to one embodiment, an image forming apparatus includes a conveyance unit configured to convey a recording material, an irradiation unit configured to radiate light on the recording material being conveyed by the conveyance unit, an image capturing unit configured to capture a plurality of times the light radiated by the irradiation unit and reflected on the recording material as surface images, an image formation unit configured to form an image on a recording material, and a control unit configured to control an image forming condition of the image formation unit, wherein the conveyance unit accelerates or decelerates a conveyance speed of the recording material in at least a part of an image capturing period during which the image capturing unit captures the surface images the plurality of times, and wherein the control unit obtains a feature quantity from a plurality of the surface images captured by the image capturing unit and controls the image forming condition based on the obtained feature quantity and a threshold value set according to the conveyance speed of the recording material in the image capturing period.

Further features will become apparent from the following description of exemplary embodiments with reference to the attached drawings.

BRIEF DESCRIPTION OF THE DRAWINGS

FIG. 9 is an example of a determination table for determining a type of a recording material according to one embodiment.

DESCRIPTION OF THE EMBODIMENTS

Hereinbelow, an exemplary embodiment will be described with reference to the appended drawings.

<Description of Configurations of Image Forming Apparatus>

Figure 1:
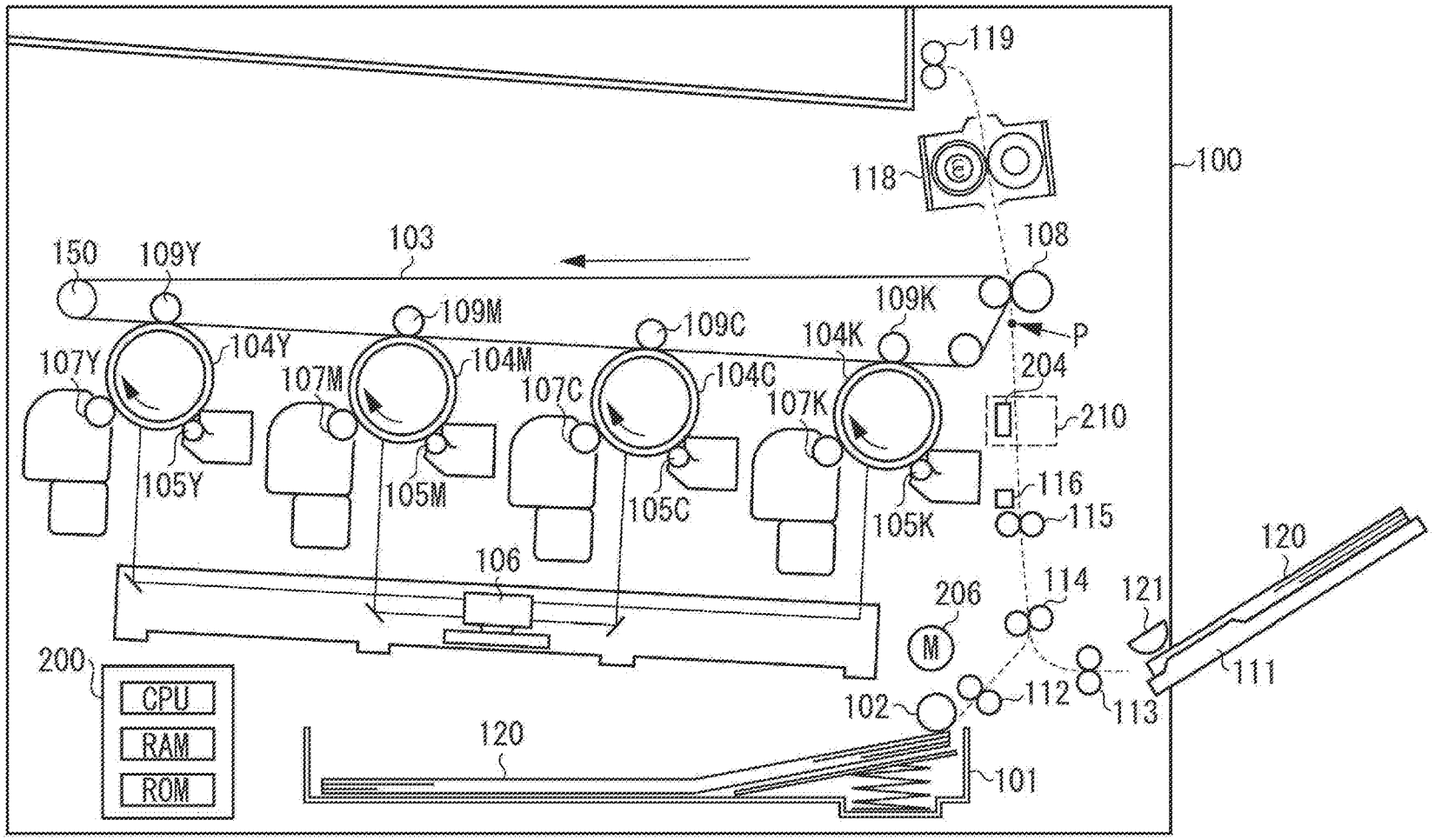
FIG. 1 is a cross-sectional diagram illustrating a configuration of an image forming apparatus according to one embodiment.

According to one exemplary embodiment, an electrophotographic laser beam printer 100 (hereinbelow, referred to as "printer 100") will be described as an example of an image forming apparatus. FIG. 1 is a diagram schematically illustrating a configuration of the printer 100.

The printer 100 is a tandem-type color printer capable of forming a color image on a recording sheet 120 (recording material) by overlapping toner in four colors of yellow (Y), magenta (M), cyan (C), and black (K). A cassette 101 is a container for storing the recording sheet 120. A conveyance path of the recording sheet 120 is indicated by a dashed line in FIG. 1. A feeding roller 102 that feeds the recording sheet 120 from the cassette 101, and a conveyance roller pairs 112 and 114, and a registration roller pair 115 that convey the fed recording sheet 120 are arranged on the conveyance path. A registration sensor 116 for detecting the recording sheet 120 is arranged in a vicinity of the registration roller pair 115. The registration sensor 116 detects a leading end (i.e., an end portion on a downstream side in a conveyance direction of the recording sheet 120) and a trailing end (i.e., an end portion on an upstream side in the conveyance direction of the recording sheet 120) of the recording sheet 120. A manual feed tray 111 stores the recording sheet 120, and a feeding roller 121 feeds the recording sheet 120 from the manual feed tray 111. The recording sheet 120 fed by the feeding roller 121 is conveyed to the conveyance roller pair 114 by a conveyance roller pair 113.

Photosensitive drums 104Y, 104M, 104C, and 104K (hereinbelow, referred to as "drums 104" or "a drum 104" unless otherwise necessary) for carrying toner are rotated by a driving source (not illustrated) in a direction indicated by an arrow in FIG. 1. Charging rollers 105Y, 105M, 105C, and 105K (hereinbelow, referred to as "charging rollers 105" or "a charging roller 105" unless otherwise necessary) uniformly charge the drums 104 in a predetermined potential. A laser scanner 106 exposes the charged drums 104 to light, and forms electrostatic latent images thereon. Development rollers 107Y, 107M, 107C, and 107K (hereinbelow, referred to as "development rollers 107" or "a development roller 107" unless otherwise necessary) feed to the drums 104 the toner that visualizes the electrostatic latent images formed on the drums 104, so that toner images are formed thereon.

Primary transfer rollers 109Y, 109M, 109C, and 109K (hereinbelow, referred to as "primary transfer rollers 109" or "a primary transfer roller 109" unless otherwise necessary) primarily transfer the toner images formed on the drums 104 onto an intermediate transfer belt 103 (hereinbelow, referred to as "belt 103"). The belt 103 is rotated by a driving roller 150 in a direction indicated by an arrow in FIG. 1. A secondary transfer roller 108 (transfer unit) transfers a toner image formed on the belt 103 onto the recording sheet 120. A fixing unit 118 (fixing device) fixes the toner image secondarily transferred on the recording sheet 120 onto the recording sheet 120 while conveying the recording sheet 120. The above-described process members constitute an image formation unit that forms an image on the recording sheet 120. A discharge roller 119 discharges the recording sheet 120 on which the image has been fixed by the fixing unit 118. A position P described below in detail is a position on the upstream side of the secondary transfer roller 108 on the conveyance path of the recording sheet 120.

A feeding-conveyance motor 206 (hereinbelow, referred to as "motor 206") serves as a driving source for driving the rollers that feed and convey the recording sheet 120. The rollers that feed and convey the recording sheet 120 and the motor 206 constitute a conveyance unit. A recording material detection unit 210 (hereinbelow referred to as "detection unit 210") detects a property of the recording sheet 120 in order to determine a type of the recording sheet 120. The detection unit 210 is configured of a surface property detection unit 204 that detects a surface property (concavo-convex state) of the recording sheet 120 as a property of the recording sheet 120. A control unit 200 controls an operation of the printer 100. A central processing unit (CPU), a random access memory (RAM), and a read only memory (ROM) are mounted on the control unit 200. The RAM (storage unit) is used for temporarily storing data necessary to control the printer 100. A program for controlling the printer 100 and various kinds of data are stored in the ROM (storage unit). The operation of the control unit 200 will be described below in detail.

<Configuration of Recording Material Detection Unit>

Figure 2A:
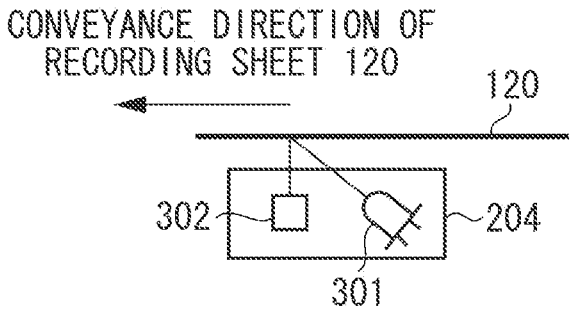
FIGS. 2A, 2B, and 2C are diagrams illustrating a configuration of a surface property detection unit according to one embodiment.
Figure 2B:
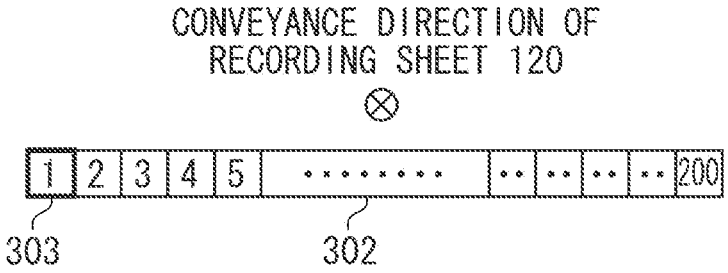
Figure 2C:
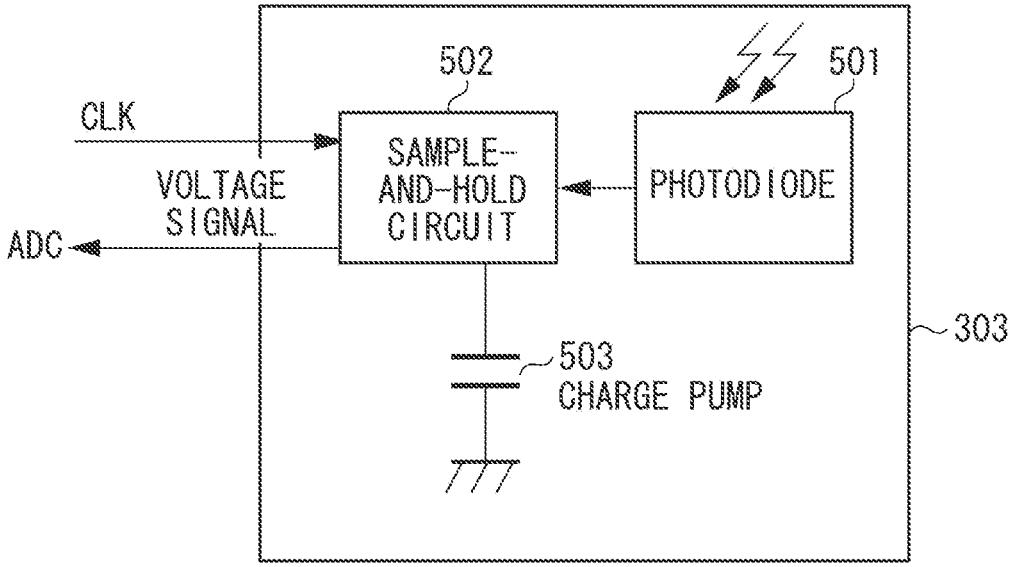

Next, the detection unit 210 will be described in detail. FIGS. 2A, 2B, and 2C are diagrams illustrating a configuration of the surface property detection unit 204 included in the detection unit 210.

FIG. 2A is a diagram illustrating a configuration of the surface property detection unit 204 viewed in a direction parallel to the conveyance surface of the recording sheet 120 and orthogonal to the conveyance direction of the recording sheet 120 (i.e., a width direction of the recording sheet 120). The surface property detection unit 204 includes an LED light emitting unit 301 (irradiation unit) that emits a predetermined amount of light to a surface of the recording sheet 120 and a line sensor 302 (image capturing unit) that captures light reflected on the surface of the recording sheet 120 as a surface image.

FIG. 2B is a diagram illustrating the line sensor 302 viewed from the upstream side in the conveyance direction of the recording sheet 120. As illustrated in FIG. 2B, 200 pieces of light receiving elements 303 for receiving light are arranged on the line sensor 302. The plurality of light receiving elements 303 is arranged in the width direction of the recording sheet 120. As one light receiving element corresponds to one pixel, an image of 200 pixels can be acquired through a single image capturing operation executed by the line sensor 302.

FIG. 2C is a block diagram illustrating a configuration of the one light receiving element 303. A photodiode 501 receives light reflected on the recording sheet 120 and outputs a current signal. The current signal output from the photodiode 501 is converted into a voltage signal through a current-voltage (I-V) conversion circuit and output to a sample-and-hold circuit 502. The sample-and-hold circuit 502 charges a capacitor of a charge pump 503 with the input voltage signal. Then, the sample-and-hold circuit 502 holds the charge pump 503 when a predetermined light receiving period T has passed. The voltage signal stored in the charge pump 503 is transmitted to an external analog-to-digital (A/D) converter and output to the control unit 200 as an output value of a corresponding pixel.

Figure 3:
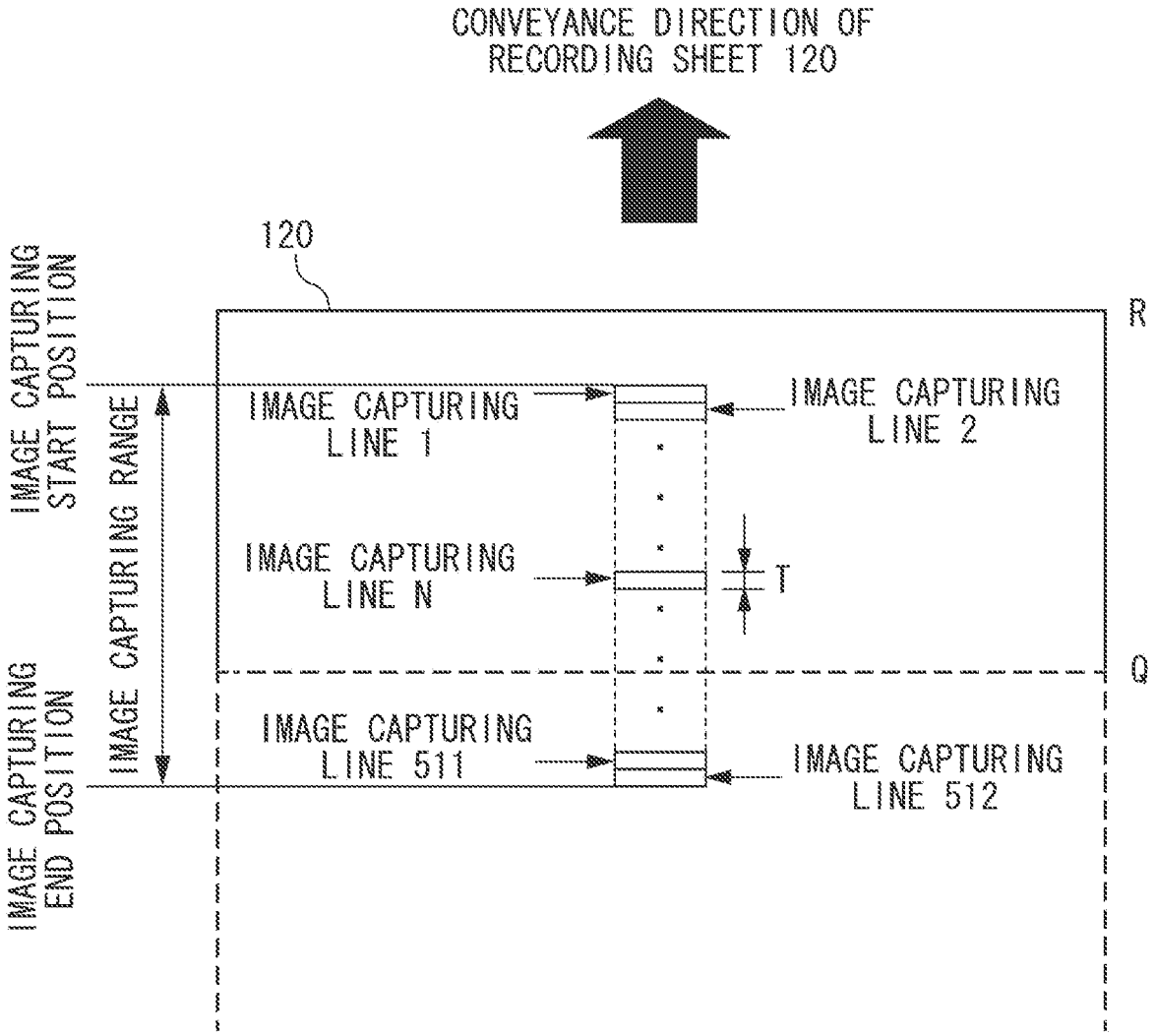
FIG. 3 is a diagram illustrating a state where images of a recording material are captured by a line sensor a plurality of times according to one embodiment.

When a surface image of the recording sheet 120 is captured by the surface property detection unit 204, a series of image capturing operations is executed repeatedly while the recording sheet 120 is being conveyed as illustrated in FIG. 3. Then, line-state captured surface images are connected to each other in the conveyance direction of the recording sheet 120, so that an image of a size corresponding to "the number of image capturing times×200 pixels" can be acquired. In FIG. 3, the image capturing operations are executed for a plurality of times in a period in which a leading end of the recording sheet 120 moves from a position Q to position R. Herein, images of the recording sheet 120 are captured for 512 times, so that an image of a size of "512×200=10240 pixels" can be acquired.

<Calculation Method of Feature Quantity and Determination Method of Image Forming Condition>

Figure 4:
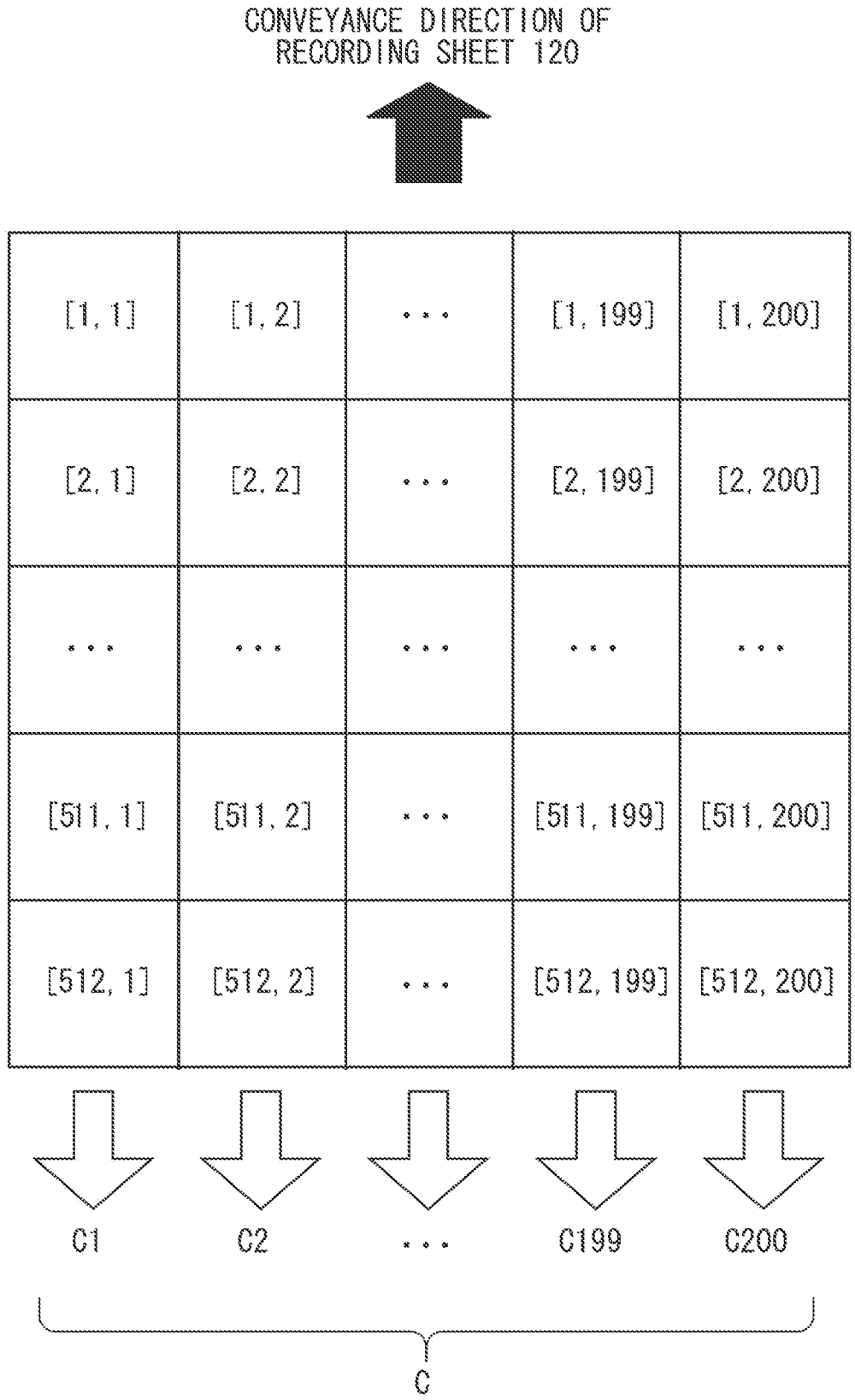
FIG. 4 is a diagram illustrating a calculation method of a parallel difference integration value according to one embodiment.

Next, description will be given of a method in which the control unit 200 calculates a feature quantity indicating a surface property of the recording sheet 120 from the surface image captured by the surface property detection unit 204. FIG. 4 is a diagram illustrating a surface image having a size of 512×200 pixels.

In the present exemplary embodiment, a parallel difference integration value will be calculated as a feature quantity. The parallel difference integration value is a value in which an amount of change of output values of a plurality of pixels arranged in each of the columns parallel to the conveyance direction of the recording sheet 120 is integrated with each other. Herein, an amount of change of output values of a plurality of pixels arranged in a predetermined column can be acquired through a method described below. For example, pixels of (1, 1), (2, 1), . . . , (511, 1), and (512, 1) are arranged consecutively, and exist in a first column. The control unit 200 calculates an absolute value of a difference of output values of the pixels (1, 1) and (2, 1), and acquires an absolute value of a difference of output values of the pixels (2, 1) and (3, 1). Then, the absolute values of the two differences are integrated. In this way, by continuously executing the calculation for acquiring and integrating an absolute value of a difference of output values of two pixels adjacent in the conveyance direction with respect to all of the pixels existing in the first column, the control unit 200 obtains an amount of change C1 of the output values of the plurality of pixels in the first column. The control unit 200 further executes similar calculation with respect to the other columns (the second to two-hundredth columns), and eventually obtains a parallel difference integration value C by integrating the amounts of change C1 to C200 of all of the columns. In addition, the control unit 200 may obtain the amount of change of the output values of a plurality of pixels in a predetermined column by calculating a maximum value and a minimum value of the output values of the plurality of pixels arranged in the predetermined column and calculating an absolute value of a difference of the maximum value and the minimum value.

The control unit 200 can determine a type (surface property) of the recording sheet 120 based on the parallel difference integration value. For example, the control unit 200 determines that the recording sheet 120 is a so-called gloss paper having a smooth surface if the parallel difference integration value is small, and determines that the recording sheet 120 is a so-called rough paper having a rough surface if the parallel difference integration value is large. Further, the control unit 200 determines that the recording sheet 120 is a plain paper if the parallel difference integration value is a value between the above two values. Then, the control unit 200 controls the image forming condition of the image formation unit according to the determined type of the recording sheet 120 (surface property).

Since the gloss paper has a resistance value lower than that of the rough paper when the thicknesses thereof are the same, a transfer current and a transfer voltage necessary for transferring a toner image onto the gloss paper are higher than in a case of the rough paper. Accordingly, the control unit 200 controls the values of the transfer current and the transfer voltage to satisfy the relationship of "rough paper<plain paper<gloss paper". Further, a fixing temperature necessary for fixing a toner image to the gloss paper is lower than that of the rough paper. Accordingly, the control unit 200 controls the fixing temperature of the fixing unit 118 to satisfy a relationship of "gloss paper<plain paper<rough paper". As described above, a quality of the image formed on the recording sheet 120 can be improved by controlling the various image forming conditions according to the type (surface property) of the recording sheet 120.

For example, a conveyance speed of the recording sheet 120, a voltage value applied to each of the primary transfer rollers 109 and the secondary transfer roller 108, a temperature for fixing an image on the recording sheet 120 at the fixing unit 118 may be considered as the image forming conditions. Herein, the conveyance speed of the recording sheet 120 is a so-called processing speed including a rotation speed of the primary transfer rollers 109 or the secondary transfer roller 108 and a rotation speed of a fixing roller that constitutes the fixing unit 118. Further, the conveyance speed of the recording sheet 120 also includes a speed at which the recording sheet 120 is fed from the feeding port (e.g., the cassette 101 or the manual feed tray 111) to the conveyance path. Furthermore, the control unit 200 may directly control the image forming condition from a calculated feature quantity value without determining the type (surface property) of the recording sheet 120.

<Timing Chart>

Subsequently, a sequence for actually determining the image forming condition of the recording sheet 120 will be described. In the present exemplary embodiment, images are consecutively formed on a plurality of recording sheets 120. Hereinbelow, the sequence will be described separately with respect to the case where an image is formed on the first recording sheet 120 and the case where images are formed on the second and the subsequent recording sheets 120.

<Image Forming Operation for the First Recording Sheet>

Figure 5A:
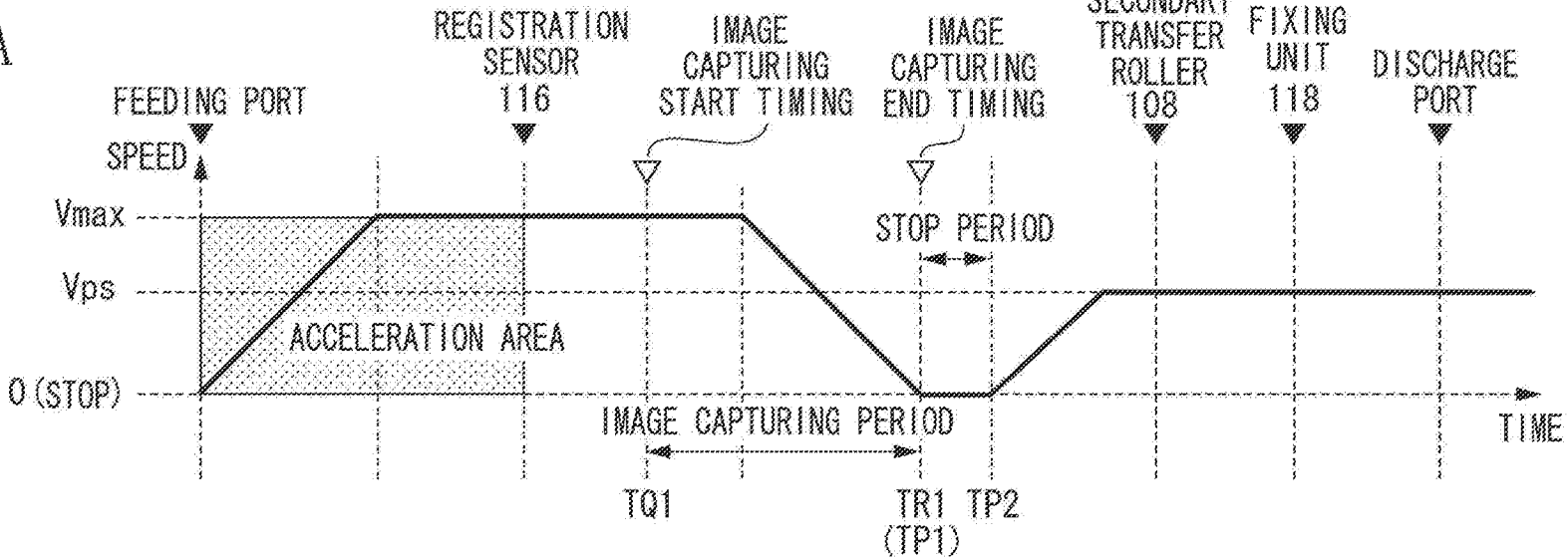
FIGS. 5A and 5B are timing charts according to an exemplary embodiment and a comparison example for forming an image on a first recording material according to one embodiment.

FIG. 5A is a timing chart of the present exemplary embodiment. In the present exemplary embodiment, the surface property detection unit 204 executes detection not only in a period during which the speed of the first recording sheet 120 is constant but also in a period during which the speed thereof is changed. In other words, the speed of the recording sheet 120 is accelerated or decelerated in at least a part of the image capturing period. In FIG. 5A, a vertical axis represents a speed of the recording sheet 120, whereas a horizontal axis represents a time passed after the recording sheet 120 is fed.

In FIG. 5A, in order to shorten the first printout time (FPOT), the first recording sheet 120 fed from the feeding port (the cassette 101 or the manual feed tray 111) is conveyed to the surface property detection unit 204 at a maximum processing speed Vmax. In the horizontal axis, a timing TQ1 represents a timing at which the leading end of the recording sheet 120 reaches a position Q illustrated in FIG. 3, whereas a timing TR1 represents a timing at which the leading end of the recording sheet 120 reaches a position R illustrated in FIG. 3. In other words, the timing TQ1 is a timing at which the surface property detection unit 204 starts image capturing, and the timing TR1 is a timing at which the surface property detection unit 204 ends the image capturing. Therefore, in FIG. 5A, a period between the timings TQ1 and TR1 is an image capturing period during which a plurality of times of image capturing are executed by the surface property detection unit 204.

When the image is formed on the first recording sheet 120, the control unit 200 controls a speed (processing speed) of the recording sheet 120, a value of the voltage applied to the secondary transfer roller 108, and a fixing temperature of the fixing unit 118 based on a detection result of the first recording sheet 120 detected by the surface property detection unit 204. Therefore, the first recording sheet 120 is stopped temporarily before the leading end thereof reaches the secondary transfer roller 108. More specifically, the first recording sheet 120 is stopped temporarily at the timing at which the leading end of the first recoding sheet 120 reaches the position P illustrated in FIG. 1. In the horizontal axis in FIG. 5A, a timing TP1 (=TR1) represents a timing at which the leading end of the recording sheet 120 reaches the position P illustrated in FIG. 1, whereas a timing TP2 represents a timing at which the recording sheet 120 is conveyed again from the position P after a predetermined stop period has passed.

The control unit 200 determines the image forming condition of the first recording sheet 120 during the stop period. When the image forming condition is determined, the image formation unit starts forming toner images on the drums 104 and the belt 103. After the stop period has passed, the first recording sheet 120 is conveyed again at a determined processing speed Vps while adjusting the conveyance timing with that of the toner image formed on the belt 103. Thereafter, the secondary transfer roller 108 transfers the toner image onto the first recording sheet 120 at a determined voltage value, and the fixing unit 118 fixes the toner image to the first recording sheet 120 at a determined fixing temperature. The recording sheet 120 on which the toner image has been formed is discharged to the outside of the printer 100 from a discharge port.

Figure 5B:
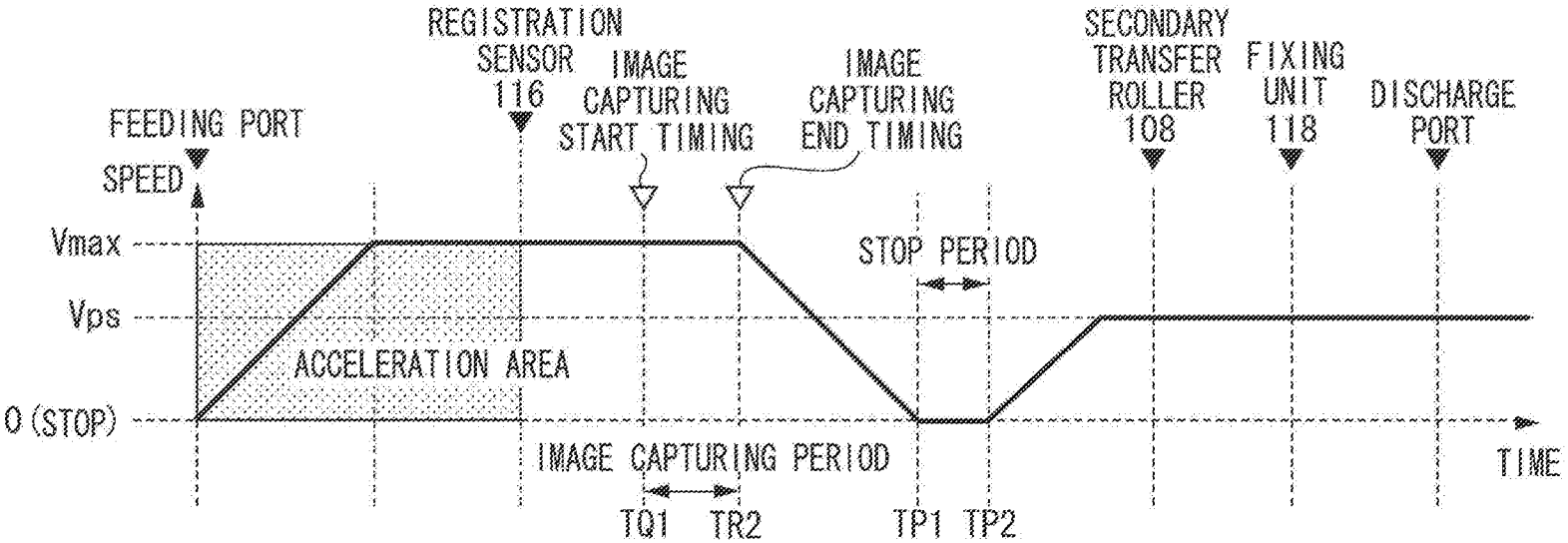

FIG. 5B is a timing chart according to a comparison example. In the comparison example, the surface property detection unit 204 executes detection only in a period during which the speed of the first recording sheet 120 is constant. In FIG. 5B, an image capturing period is a period between the timings TQ1 and TR2, so that the image capturing period is shortened by a period between the timings TR2 and TR1 when comparing that with the image capturing period in FIG. 5A.

As illustrated in FIG. 1, the surface property detection unit 204 and the secondary roller 108 are arranged in a short distance on the conveyance path. Therefore, in FIG. 5B, the image capturing period is set to a period between the timings TQ1 and TR2 in consideration of a deceleration period during which the recording sheet 120 conveyed at the maximum processing speed Vmax is stopped. In such a short image capturing period, the surface image of the recording sheet 120 cannot be captured sufficiently, so that the image quality will be degraded because a accuracy for determining the type of the recording sheet 120 is lowered. On the other hand, if a distance between the surface property detection unit 204 and the secondary transfer roller 108 on the conveyance path is set to be longer in order to ensure a long image capturing period for the surface property detection unit 204, a size of the printer 100 will be increased. Further, although it is also possible to set the image capturing period of the surface property detection unit 204 to be longer by lowering the conveyance speed of the first recording sheet 120 fed thereto, the FPOT will be longer.

<Image Forming Operation for the Second and the Subsequent Recording Sheets>

Figure 6A:
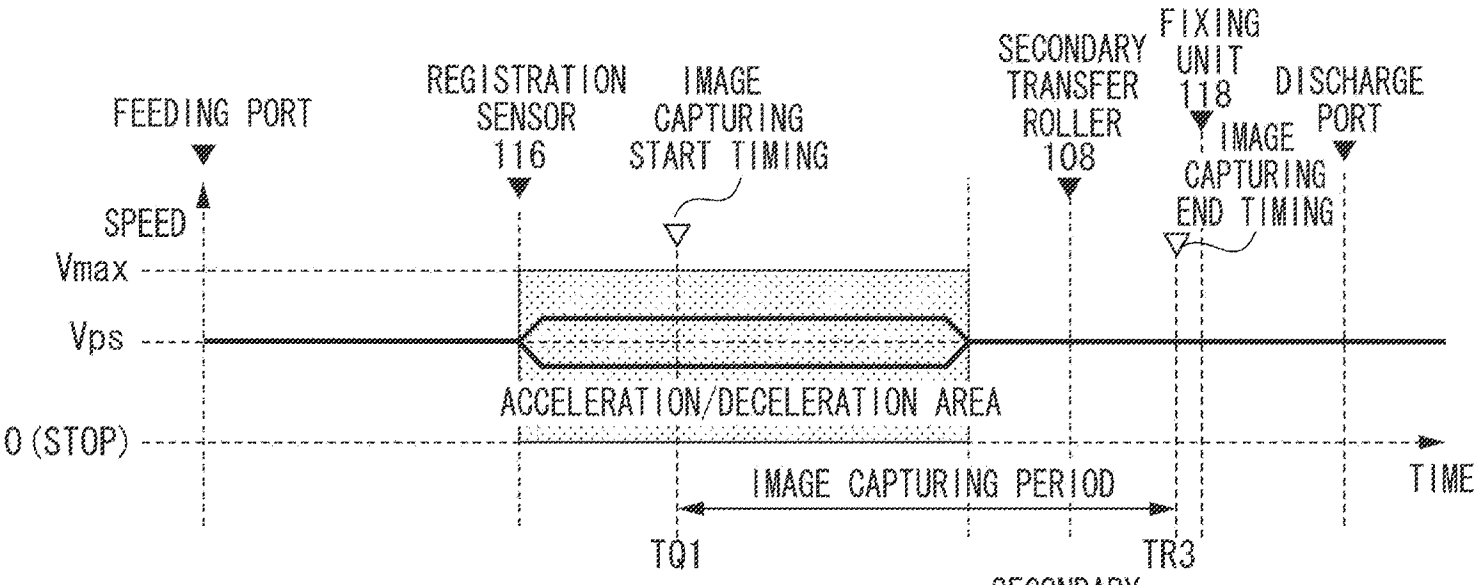
FIGS. 6A and 6B are timing charts according to one embodiment and the comparison example for forming images on a second and a subsequent recording materials.

FIG. 6A is a timing chart according to the present exemplary embodiment. In the present exemplary embodiment, the surface property detection unit 204 executes detection not only in a period during which the speed of the second or the subsequent recording sheet 120 is constant but also in a period during which the speed thereof is changed. In other words, the speed of the recording sheet 120 is accelerated or decelerated in at least a part of the image capturing period. In FIG. 6A, a vertical axis represents a speed of the recording sheet 120, whereas a horizontal axis represents a time passed after the recording sheet 120 is fed thereto.

In FIG. 6A, the second and the subsequent recording sheets 120 are conveyed at the processing speed Vps that is determined when the first recording sheet 120 is detected by the surface property detection unit 204. Further, in FIG. 6A, based on the timing at which the registration sensor 116 detects a leading end of the recording sheet 120, the control unit 200 executes acceleration/deceleration control of the recording sheet 120. Through the acceleration/deceleration control, a conveyance position of the recording sheet 120 is adjusted, and a toner image is transferred onto a desired position on the recording sheet 120. The timing TQ1 is a timing at which the surface property detection unit 204 starts image capturing, and the timing TR3 is a timing at which the surface property detection unit 204 ends the image capturing. In other words, in FIG. 6A, a period between the timings TQ1 and TR3 is an image capturing period during which a plurality of times of image capturing is executed by the surface property detection unit 204.

When images are to be formed on the second and the subsequent recording sheets 120, a detection result of the first recording sheet 120 is used not only for the conveyance speed of the recording sheet 120 but also for the voltage value applied to the secondary transfer roller 108. With this configuration, productivity of the printer 100 is improved because the second and the subsequent recording sheets 120 do not have to be temporarily stopped at the stop position P positioned in the upstream of the secondary transfer roller 108. When images are formed on the second and the subsequent recording sheets 120, the control unit 200 controls the fixing temperature of the fixing unit 118 based on detection results of the second and the subsequent recording sheets 120 detected by the surface property detection unit 204. Since the fixing temperature is controlled according to the individual differences of the second and the subsequent recording sheets 120, it is possible to prevent unnecessary power consumption. Further, the fixing temperature of the fixing unit 118 has already been increased to a predetermined temperature based on the detection result of the first recording sheet 120. Therefore, it is not necessary to temporarily stop the second and the subsequent recording sheets 120 in order to make a fine adjustment on the fixing temperature based on the detection results of the second and the subsequent recording sheets 120. The fixing unit 118 fixes the toner images to the second and the subsequent recording sheets 120 at the finely-adjusted fixing temperatures. The recording sheets 120 on which the toner images have been formed are discharged to the outside of the printer 100 from the discharge port.

Now, the acceleration/deceleration control will be described in detail. When a preceding recording sheet 120 is ready to be conveyed by the process member such as the secondary transfer roller 108 to which the motor 206 does not contribute after the registration sensor 116 has detected the trailing end of the preceding recording sheet 120, the acceleration/deceleration control can be executed on the following recording sheet 120. Then, the control unit 200 determines whether the timing at which the leading end of the following recording sheet 120 is detected by the registration sensor 116 is earlier or later than a reference timing. Herein, the reference timing refers to a timing at which a toner image is transferred onto a desired position on the following recording sheet 120 by the secondary transfer roller 108 if the following recording sheet 120 is conveyed at the processing speed Vps without any change. When the control unit 200 determines that the detection timing detected by the registration sensor 116 is different from the reference timing, the control unit 200 changes the conveyance speed of the recording sheet 120 from the processing speed Vps in order to transfer the toner image to a desired position on the following recording sheet 120.

For example, when the following recording sheet 120 is considerably brought out at the feeding port (the cassette 101 or the manual feed tray 111), the detection timing of the registration sensor 116 becomes earlier than the reference timing. In this case, the control unit 200 decelerates the conveyance speed of the following recording sheet 120 from the processing speed Vps. On the other hand, when the following recording sheet 120 slips while being fed by the feeding roller 102 or 121, the detection timing of the registration sensor 116 is later than the reference timing. In this case, the control unit 200 accelerates the conveyance speed of the following recording sheet 120 from the processing speed Vps.

Figure 6B:
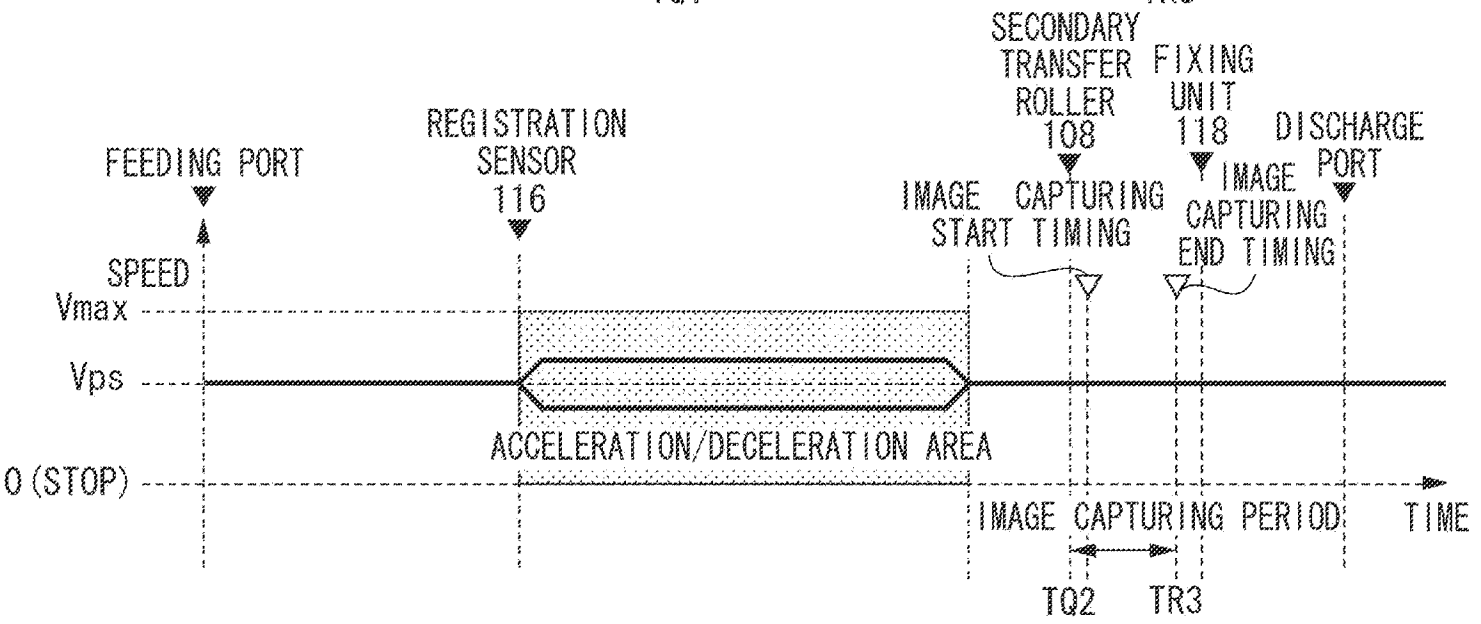

FIG. 6B is a timing chart according to the comparison example. In the comparison example, the surface property detection unit 204 executes detection only in a period during which the speed of the second or the subsequent recording sheet 120 is constant. In FIG. 6B, the image capturing period is a period between the timings TQ2 and TR3, so that the image capturing period is shortened by a period between the timings TQ1 and TQ2 when comparing that with the image capturing period in FIG. 6A. Accordingly, similar to the comparison example illustrated in FIG. 5A, the surface image of the recording sheet 120 cannot be captured sufficiently, so that the image quality will be degraded because an accuracy for determining the type of the recording sheet 120 is lowered.

In the present exemplary embodiment, the surface property detection unit 204 executes the detection also in a period during which the speed of the recording sheet 120 is changed, so that the image capturing period is extended as illustrated in the timing charts in FIGS. 5A and 6A. For example, if an image is captured by the surface property detection unit 204 in a state where the speed of the recording sheet 120 is being changed, for example, accelerated, an image blur occurs in the captured image, and the acquired feature quantity is affected thereby. In order to capture the image without having an image blur, the light receiving period T for capturing a single image may be changed according to the speed of the recording sheet 120. In a case where the light receiving period T is changed, a brightness of the captured image is changed, and thus an amount of irradiation light emitted from the LED light emitting unit 301 has to be also adjusted. In other words, the light receiving period T and the amount of irradiation light have to be finely adjusted according to the speed of the recording sheet 120. However, as it is difficult to finely adjust the light receiving period T and the amount of irradiation light emitted from the LED light emitting unit 301 according to the speed of the recording sheet 120, in the present exemplary embodiment, the image forming condition is determined by determining the type of the recording sheet 120 without changing the light receiving period T and the amount of irradiation light. Hereinbelow, the above method will be described in detail.

<Normalization of Feature Quantity According to Number of Image Capturing Times>

Figure 7:
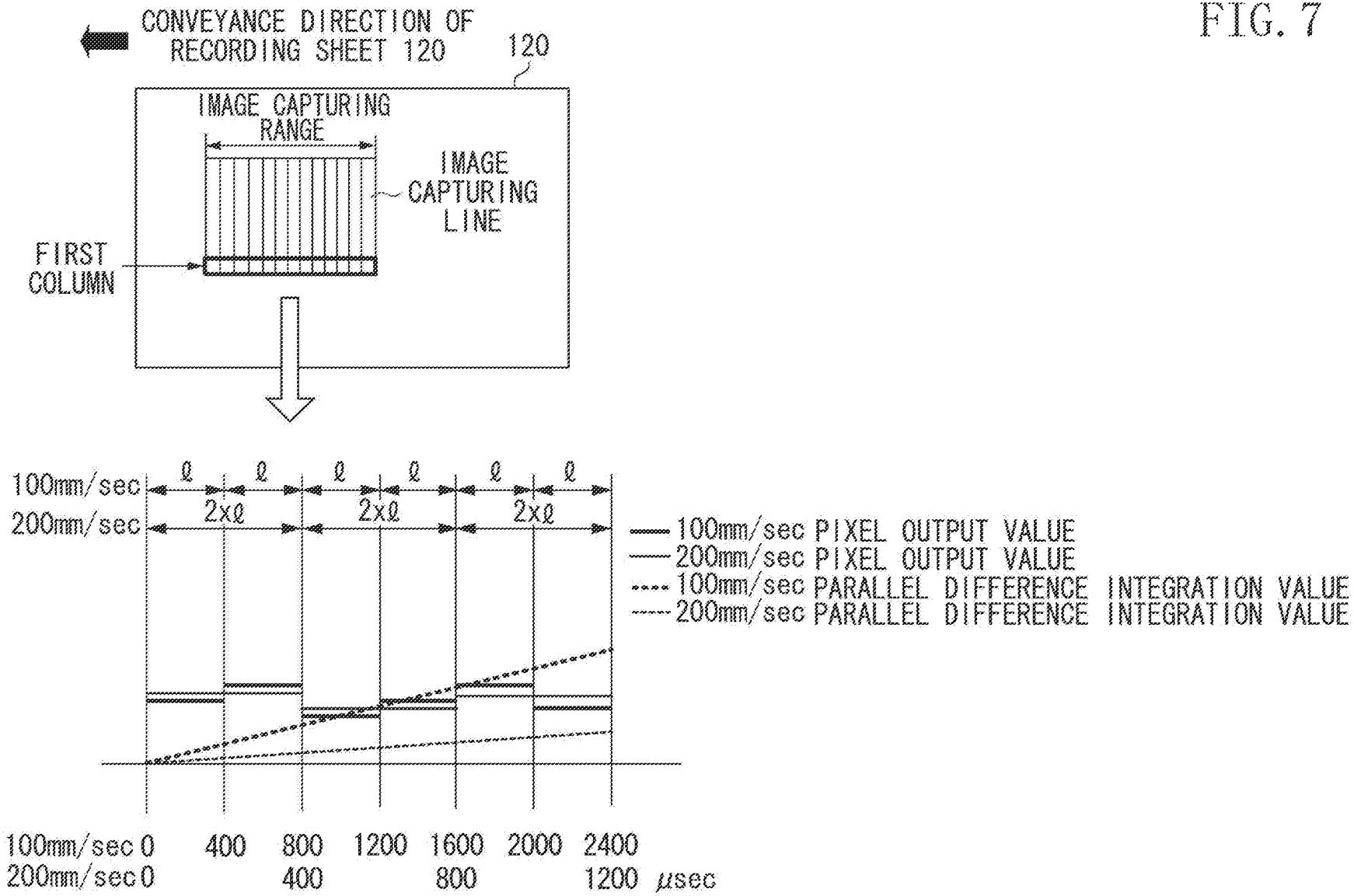
FIG. 7 is a graph illustrating output values of a plurality of pixels and parallel difference integration values acquired at two different speeds according to one embodiment.

FIG. 7 is a graph illustrating data of a surface image captured by the surface property detection unit 204 when the recording sheet 120 is conveyed at two different speeds. The graph in FIG. 7 illustrates output values and parallel difference integration values of a plurality of pixels in the first column when the recording sheet 120 is conveyed at the conveyance speeds of 100 mm/sec and 200 mm/sec. Herein, the light receiving period T for capturing each line image is fixed to 400 μsec in both cases of the conveyance speeds of 100 mm/sec and 200 mm/sec. If an image capturing range of the recording sheet 120 (i.e., a length in the conveyance direction of the recording sheet 120) at one time of image capturing at the conveyance speed of 100 mm/sec is assumed as "1", an image capturing range of the recording sheet 120 at one time of image capturing at the conveyance speed of 200 mm/sec is "21". In other words, in order to capture the same range of "21", the image capturing has to be executed two times when the conveyance speed is 100 mm/sec, and the image capturing has to be executed one time when the conveyance speed is 200 mm/sec.

A vertical axis of the graph in FIG. 7 represents an output value and a parallel difference integration value of a pixel, whereas the horizontal axis represents an image capturing range of the recording sheet 120. As described above, in order to capture the same range, the image capturing has to be executed two times when the conveyance speed is 100 mm/sec while the image capturing has to be executed one time when the conveyance speed is 200 mm/sec. Therefore, an output value of one-pixel acquired at the conveyance speed of 200 mm/sec is illustrated in a range where an output value of two pixels acquired at the conveyance speed of 100 mm/sec is illustrated. As illustrated in FIG. 7, the output value of one pixel acquired at the conveyance speed of 200 mm/sec is equivalent to an average value of the two-pixel worth of output value acquired at the conveyance speed of 100 mm/sec.

In the graph in FIG. 7, when image capturing results of the same range are compared to each other, a parallel difference integration value acquired at the conveyance speed of 200 mm/sec is smaller than the parallel difference integration value acquired at the conveyance speed 100 mm/sec. In the present exemplary embodiment, because the light receiving period T for capturing each line image is set to be constant, the number of image capturing times at the conveyance speed of 200 mm/sec is half the number of image capturing times at the conveyance speed of 100 mm/sec. Accordingly, the parallel difference integration value will be smaller because the number of pieces of data as a target of parallel difference integration is half the number thereof. Therefore, in a case where the number of image capturing times is changed, the parallel difference integration value has to be normalized by the reference number of image capturing times. The normalization method will be described below in detail.

<Relationship between Speed of Recording Sheet and Normalized Feature Quantity>

Figure 8:
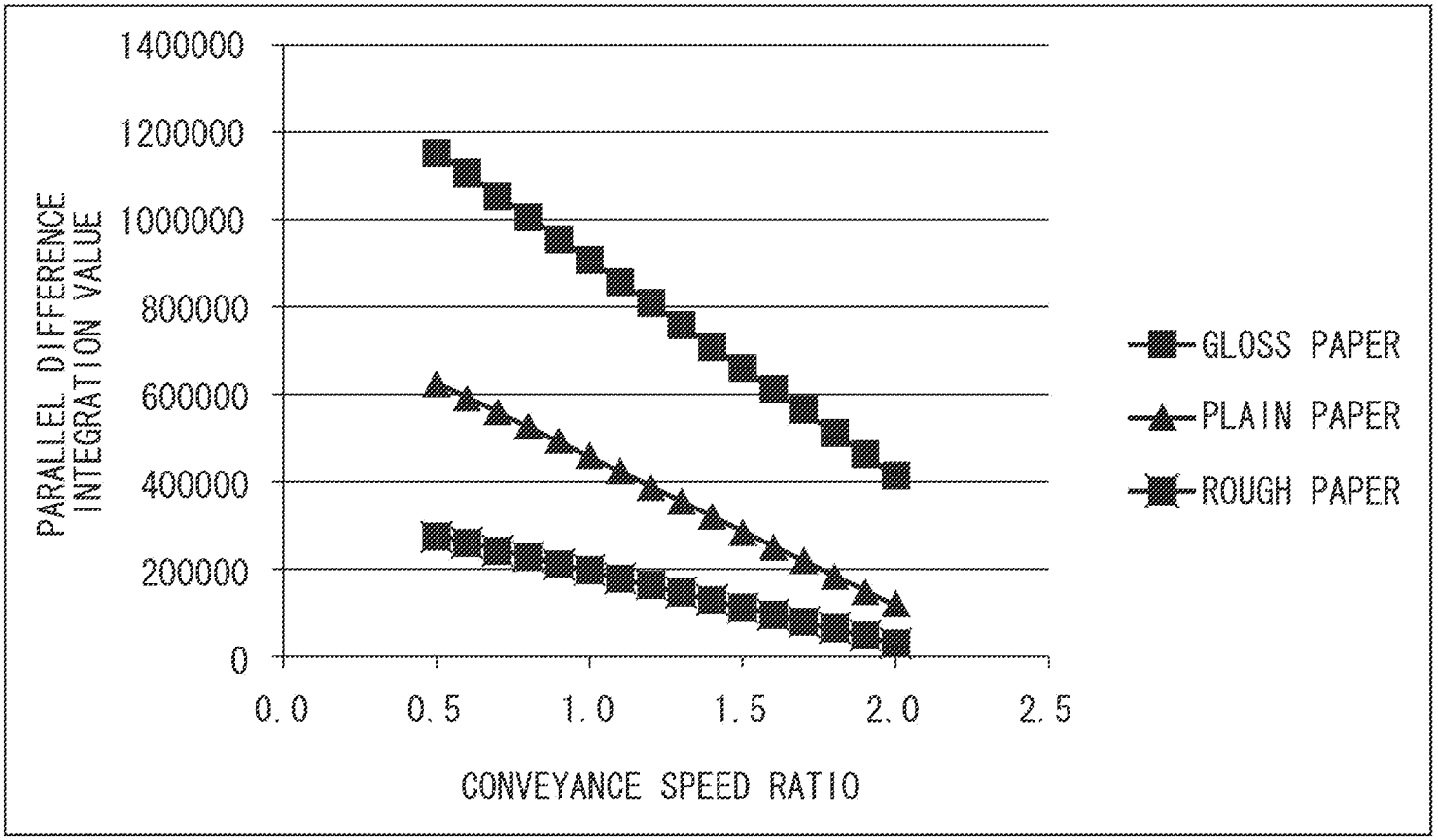
FIG. 8 is a graph illustrating a relationship between a conveyance speed ratio and a parallel difference integration value according to one embodiment.

FIG. 8 is a graph illustrating a parallel difference integration value normalized by a reference number of image capturing times. A vertical axis of the graph in FIG. 8 represents a normalized parallel difference integration value, whereas a horizontal axis represents a ratio of an average speed of the recording sheet 120 with respect to a reference conveyance speed. The average speed of the recording sheet 120 refers to an average speed in the image capturing period. As illustrated in the graph in FIG. 8, a parallel difference integration value is smaller if a conveyance speed ratio is greater. Further, a relationship between the conveyance speed ratio and the parallel difference integration value is changed depending on the type of the recording sheet 120, so that it is necessary to previously obtain the relationship for each type of the recording sheet 120 to be determined. More specifically, a slope "a" and an intercept "b" in the following linear equation (Formula 1) is acquired from data of parallel difference integration values of at least two conveyance speed ratios.

$$y=a\times x+b \quad (1)$$

In the formula 1, a value "x" represents a conveyance speed ratio of the average speed of the recording sheet 120 when a reference conveyance speed V is 1, and a value "y" represents a parallel difference integration value normalized by the reference number of image capturing times.

FIG. 9 is a determination table on which the relationship with respect to the conveyance speed ratio acquired as the above is reflected. Two threshold values, a first and a second threshold values, are illustrated in the determination table in FIG. 9. When the normalized parallel difference integration value is equal to or lower than the first threshold value and equal to or higher than the second threshold value, the control unit 200 determines that the type of the recording sheet 120 is a plain paper. When the normalized parallel difference integration value is higher than the first threshold value, the control unit 200 determines that the type of the recording sheet 120 is rough paper. When the normalized parallel difference integration value is lower than the second threshold value, the control unit 200 determines that the type of the recording sheet 120 is gloss paper. The determination table illustrated in FIG. 9 is stored in the ROM mounted on the control unit 200.

In summary, the control unit 200 calculates the parallel difference integration value from the image captured by the surface property detection unit 204 and normalizes the parallel difference integration value with the reference number of image capturing times. Then, the control unit 200 obtains the average speed of the recording sheet 120 in the image capturing period, and determines the type (surface property) of the recording sheet 120 by using the determination table in FIG. 9. The control unit 200 determines the image forming condition according to the determined type (surface property).

In addition, although the number of image capturing times of the surface property detection unit 204 has been changed in order to capture the same range of the recording sheet 120, the present exemplary embodiment is not limited thereto. When the surface property detection unit 204 consistently executes the same number of times (reference number of times) of image capturing, the control unit 200 can determine the type (surface property) of the recording sheet 120 by using the determination table in FIG. 9 without normalizing the acquired feature quantity and can determine the image forming condition.

<Functional Block Diagram of Control Unit>

Figure 10:
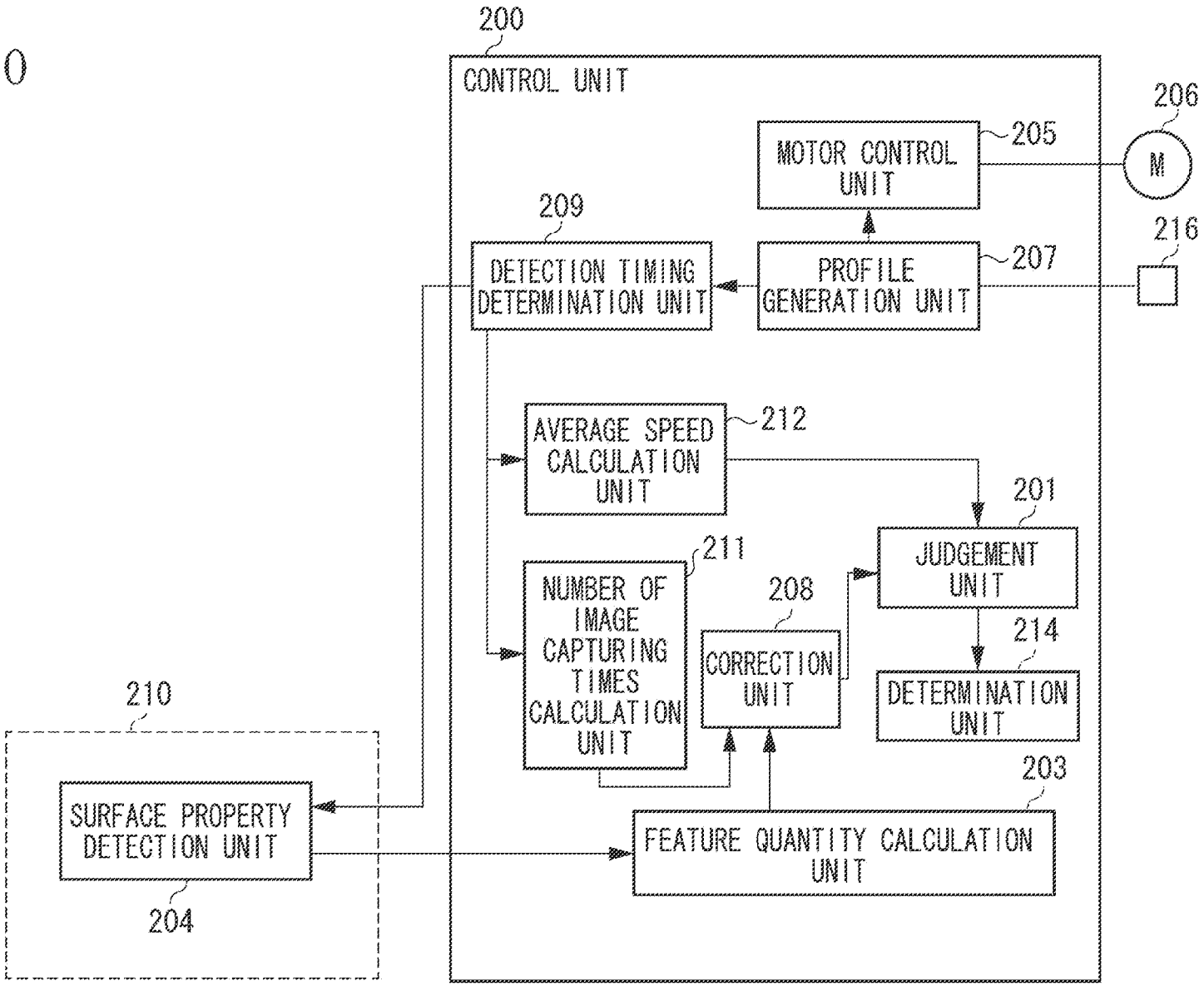
FIG. 10 is a functional block diagram of a control unit according to one embodiment.

FIG. 10 is a functional block diagram of the control unit 200 according to the present exemplary embodiment for realizing the above-described control. The CPU mounted on the control unit 200 realizes the respective functions by executing a program stored in the ROM or the like.

The control unit 200 includes a motor control unit 205, a profile generation unit 207, and a detection timing determination unit 209. The profile generation unit 207 generates speed profile information of the recording sheet 120 based on the timing at which a leading end of the recording sheet 120 is detected by the registration sensor 116. In the present exemplary embodiment, as illustrated in FIGS. 5A and 6A, the speed profile information is information indicating a timing at which the conveyance speed of the recording sheet 120 is accelerated or decelerated, or information indicating an extent to which the conveyance speed is accelerated or decelerated. The profile generation unit 207 transmits the generated speed profile information to the motor control unit 205 and the detection timing determination unit 209. The motor control unit 205 controls the motor 206 based on the received speed profile information to accelerate or decelerate the conveyance speed of the recording sheet 120. Based on the received speed profile information, the detection timing determination unit 209 determines a timing at which the surface property detection unit 204 starts or ends the image capturing of the recording sheet 120, and transmits the timing to the surface property detection unit 204. Further, the detection timing determination unit 209 calculates the image capturing range of the recording sheet 120 and a length of the image capturing period from the determined detection timing, and transmits the calculated information to a number of image capturing times calculation unit 211 and an average speed calculation unit 212 described below.

The surface property detection unit 204 executes image capturing of the recording sheet 120 based on the detection timing transmitted from the detection timing determination unit 209. The acquired image information is transmitted to the feature quantity calculation unit 203, so that the above-described parallel difference integration value is calculated as a feature quantity that indicates a surface property of the recording sheet 120. The control unit 200 further includes a correction unit 208, a judgment unit 201, and a determination unit 214. The correction unit 208 corrects the feature quantity calculated by the feature quantity calculation unit 203 based on the number of image capturing times calculated by the number of image capturing times calculation unit 211. The judgment unit 201 judges a type (surface property) of the recording sheet 120 based on the feature quantity corrected by the correction unit 208 and the average speed of the recording sheet 120 calculated by the average speed calculation unit 212. The determination unit 214 determines the image forming condition according to the type (surface property) of the recording sheet 120 judged by the judgment unit 201.

<Description of Flowchart>

Figure 11:
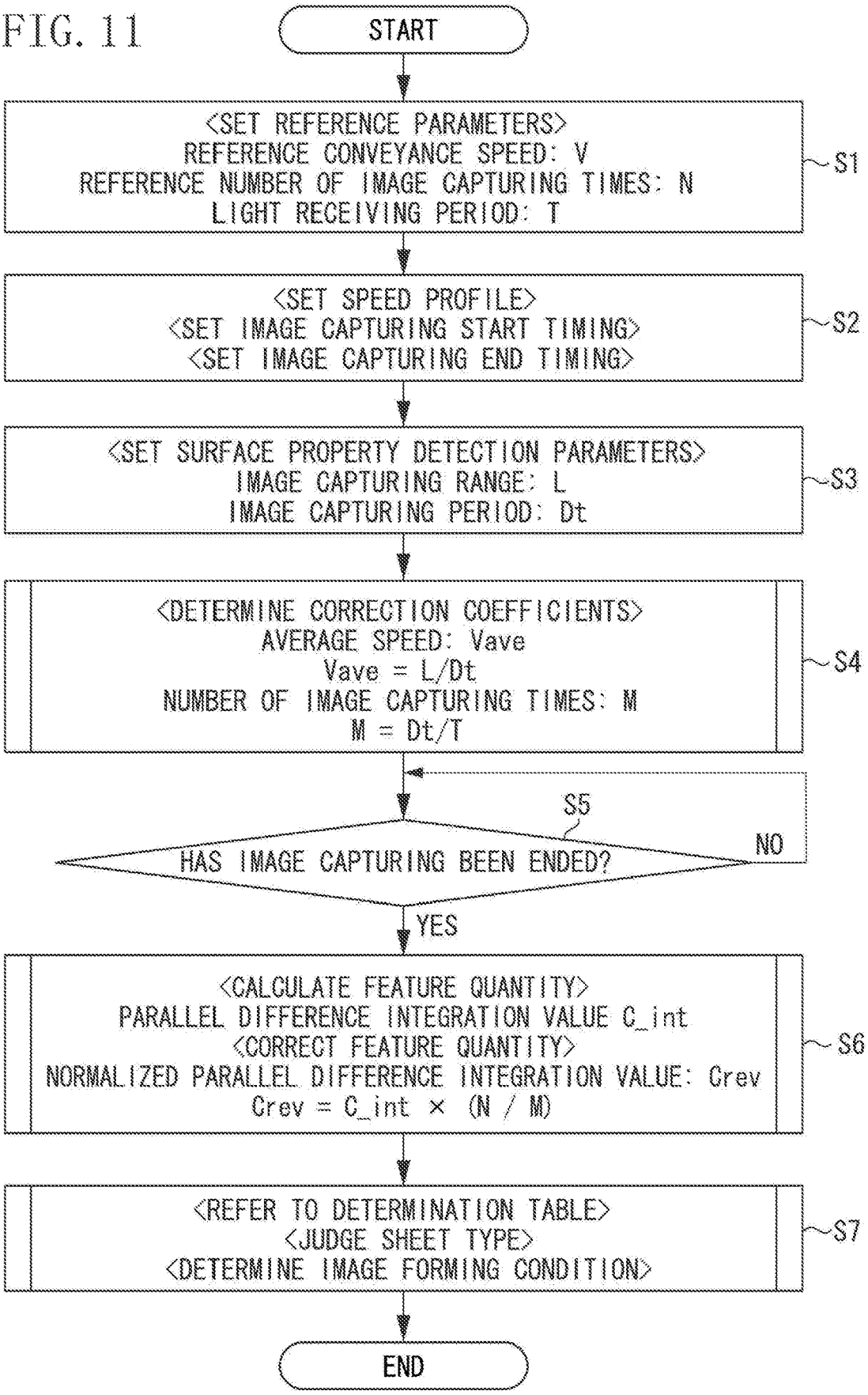
FIG. 11 is a flowchart illustrating processing for deciding an image forming condition according to one embodiment.

Next, a flowchart according to the present exemplary embodiment illustrated in FIG. 11 will be described. The control based on the flowchart in FIG. 11 is executed by the CPU mounted on the control unit 200 based on the program stored in the ROM (not illustrated).

In step S1, the control unit 200 sets reference parameters. In the present exemplary embodiment, a reference conveyance speed V, a reference number of image capturing times N, and a light receiving period T for executing the image capturing one time are set as 100 mm/sec, 512 times, and 0.423 msec, respectively.

In step S2, based on the timing at which the leading end of the recording sheet 120 is detected by the registration sensor 116, the control unit 200 sets speed profile information and image capturing start and end timings of the surface property detection unit 204.

In step S3, the control unit 200 sets surface property detection parameters. The surface property detection parameters are an image capturing range L of the recording sheet 120 (i.e., a length in the conveyance direction of the recording sheet 120) and an image capturing period Dt of the surface property detection unit 204.

In step S4, the control unit 200 determines correction coefficients for correcting the feature quantity. Based on the speed profile information set in step S2, the control unit 200 calculates an average speed Vave of the recording sheet 120 in the image capturing period as a correction coefficient through the following formula 2. Further, the control unit 200 acquires a number of image capturing times M during the image capturing period Dt as a correction coefficient through the following formula 3.

$$Vave=L/Dt \quad (2)$$

$$M=Dt/T \quad (3)$$

In step S5, the surface property detection unit 204 starts image capturing of the recording sheet 120 at the image capturing start timing determined in step S2, and executes image capturing a plurality of times until the image capturing end timing determined in step S2 (NO in step S5). In step S5, when the image capturing is ended (YES in step S5), the processing proceeds to step S6. In step S6, the control unit 200 calculates a parallel difference integration value C_int from the captured surface image as the feature quantity. Then, the control unit 200 normalizes the parallel difference integration value C_int by the reference number of image capturing times N set in step S1 and the number of image capturing times M acquired in step S4. The normalized parallel difference integration value Crev is calculated by the following formula 4.

$$Crev=C_int\times(N/M) \quad (4)$$

In step S7, the control unit 200 determines the type of the recording sheet 120 based on the normalized parallel difference integration value Crev acquired in step S6 and the average speed Vave calculated in step S4. The type of the recording sheet 120 can be determined by the determination table illustrated in FIG. 9. For example, when the conveyance speed ratio is 2.0 while the normalized parallel difference integration value Crev is 250000, the control unit 200 determines that the sheet type is a plain paper because the value Crev exists within a range between the second threshold value 60000 and the first threshold value 380000.

In addition, in a case where an image is formed on the first recording sheet 120, the parameters are uniquely determined in steps S2 to S4 based on the distance between the surface property detection unit 204 and the stop position P on the conveyance path, the maximum processing speed Vmax, and a deceleration degree of the motor 206. Accordingly, the above operation may be executed by using preset parameters stored in the ROM based on the configuration of the printer 100. For example, the operation may be executed by using a preset average speed Vave stored in advance in the ROM based on the configuration of the printer 100.

On the other hand, in a case where images are formed on the second and the subsequent recording sheets 120, a timing at which a leading end of the recording sheet 120 is detected by the registration sensor 116 is different at each time. Accordingly, the profile generation unit 207 has to generate the speed profile information with respect to each of the second and the subsequent recording sheets 120. In other words, in steps S2 to S4, the control unit 200 has to calculate various parameters with respect to each of the second and the subsequent recording sheets 120.

As described above, according to the present exemplary embodiment, it is possible to provide an image forming apparatus capable of forming a high-quality image by determining an image forming condition according to a surface state of a recording material without executing a complicated detection operation even in a case where a speed of the recording material is accelerated or decelerated. Further, a shortening of the FPOT and an improvement in productivity of the second and the subsequent recording materials can be expected, and an image capturing range can be widened.

Variation Example

As illustrated in FIG. 9, according to the above-described exemplary embodiment, a type (surface property) of the recording sheet 120 is determined by using a determination table of the parallel difference integration value and the conveyance speed ratio of the recording sheet 120. However, the exemplary embodiment is not limited thereto. For example, the parallel difference integration value as a feature quantity may be corrected based on the conveyance speed ratio of the recording sheet 120.

Further, in the above-described exemplary embodiment, although the detection unit 210 is fixedly mounted on the printer 100, the detection unit 210 may be detachably mounted to the printer 100. If the detection unit 210 is detachably mounted thereon, for example, a user can easily replace the detection unit 210 when any trouble has occurred therein. Alternatively, the detection unit 210 may be simply and additionally mountable to the printer 100.

Further, in the above-described exemplary embodiment, the detection unit 210 and the control unit 200 may be integrated into a recording material determination apparatus and detachably mounted on the printer 100. As described above, if the detection unit 210 and the control unit 200 can be replaced integrally, the user can easily replace the detection unit 210 with a detection unit having a new function when a function thereof is updated or added. Further, the detection unit 210 and the control unit 200 may be simply integrated so as to be additionally mountable on the printer 100.

Further, in the above-described exemplary embodiment, although a laser beam printer has been described as an example, the image forming apparatus to which the present invention is applied is not limited thereto, and thus the image forming apparatus may be a printer of another printing system such as an inkjet printer, or may be a copying machine.

While exemplary embodiments have been described, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a mechanical conveying device that conveys a recording material on a conveyance path in the image forming apparatus;

a radiation source that radiates light on segments of the recording material being conveyed by the mechanical conveying device, the light radiated on a segment of the recording material as the segment is being conveyed through an irradiation section of the conveyance path;

an image capturing device that captures the light radiated by the radiation source and reflected on the recording material as a surface image;

an image formation device that forms an image on a recording material; and a controller configured to control an image forming condition of the image formation device, wherein the mechanical conveying device accelerates or decelerates a conveyance speed of the recording material in at least a part of an image capturing period during which the image capturing device captures the surface image a plurality of times, the image capturing device being configured to capture the surface image not depending on the conveyance speed of the recording material, wherein the image forming apparatus obtains feature quantity data on the basis of data obtained from the captured surface images, wherein the feature quantity data reflects a feature of the recording material, and wherein the controller controls the image forming condition based on the obtained feature quantity data and an average conveyance speed of the recording material in the image capturing period.

2. The image forming apparatus according to claim 1, wherein the controller corrects the obtained feature quantity data based on the number of times the image capturing device captures the surface image, and controls the image forming condition based on the corrected feature quantity data and a threshold value.

3. The image forming apparatus according to claim 1, wherein, in each of the plurality of surface images captured by the image capturing device, a plurality of pixels exists in each of a first column and a second column parallel to a conveyance direction of the recording material, and wherein the controller obtains the feature quantity data by integrating an amount of change of output values of a plurality of pixels arranged in the first column and an amount of change of output values of a plurality of pixels arranged in the second column.

4. The image forming apparatus according to claim 3, wherein, in the plurality of surface images captured by the image capturing device, a plurality of pixels exists in a predetermined column parallel to the conveyance direction of the recording material, and wherein, with respect to all of the pixels existing in the predetermined column, the controller obtains an amount of change of output values of the plurality of pixels by obtaining and integrating an absolute value of a difference of output values of two pixels adjacent to one another in the conveyance direction of the recording material.

5. The image forming apparatus according to claim 1, wherein the image formation device includes a transfer device that transfers an image onto a recording material, and wherein, in a case where the mechanical conveying device stops the recording material at a predetermined position on an upstream side of the transfer device in a conveyance direction of the recording material to allow the controller to control the image forming condition with respect to the recording material after the surface images of the recording material are captured by the image capturing device, the mechanical conveying device decelerates a conveyance speed of the recording material in at least a part of the image capturing period to stop the recording material at the predetermined position.

6. The image forming apparatus according to claim 5, wherein, in a case where an image is formed on a first recording material by the image formation device, the mechanical conveying device stops the recording material at the predetermined position.

7. The image forming apparatus according to claim 5 further comprising a storage configured to store the average conveyance speed of the recording material in the image capturing period, wherein the controller controls the image forming condition based on the obtained feature quantity data and a threshold value set according to the average conveyance speed of the recording material stored in the storage.

8. The image forming apparatus according to claim 1 further comprising a sensor configured to detect a recording material on an upstream side of the image formation device in the conveyance direction of the recording material, wherein the image formation device includes a transfer device that transfers an image onto a recording material, and wherein, in a case where the mechanical conveying device accelerates or decelerates a conveyance speed of the recording material without stopping the recording material to allow the transfer device to transfer the image onto the recording material based on a timing at which the recording material is detected by the sensor, the mechanical conveying device accelerates or decelerates the conveyance speed of the recording material in at least a part of the image capturing period.

9. The image forming apparatus according to claim 8, wherein, in a case where an image is formed on a second recording material by the image formation device, the mechanical conveying device accelerates or decelerates conveyance speeds of the second recording material without stopping the second recording material.

10. The image forming apparatus according to claim 8, wherein the controller obtains the average conveyance speed of the recording material in the image capturing period based on the timing at which the sensor detects the recording material, and controls the image forming condition based on the obtained feature quantity data and a threshold value set according to the obtained average conveyance speed of the recording material.

11. The image forming apparatus according to claim 1, wherein, in the image capturing period, the radiation source does not change an amount of light radiated on the recording material, and the image capturing device does not change a light receiving period, which is a period for capturing the surface image, for receiving and capturing light reflected on the recording material.

12. The image forming apparatus according to claim 1, wherein the image capturing device is a line sensor including a plurality of light receiving elements arranged in a direction parallel to a conveyance surface of the recording material and orthogonal to the conveyance direction of the recording material.

13. The image forming apparatus according to claim 1, wherein the image forming condition is a conveyance speed of a recording material, a voltage value applied to a transfer device included in the image formation device, or a temperature at which a fixing device included in the image formation device fixes an image on a recording material.

14. An image forming apparatus comprising:

a mechanical conveying device that conveys a recording material on a conveyance path in the image forming apparatus;

a radiation source that radiates light on segments of the recording material being conveyed by the mechanical conveying device, the light radiated on a segment of the recording material as the segment is being conveyed through an irradiation section of the conveyance path;

an image capturing device that captures the light radiated by the radiation source and reflected on the recording material as a surface image;

an image formation device that forms an image on a recording material; and a controller unit configured to control an image forming condition of the image formation device, wherein the mechanical conveying device accelerates or decelerates a conveyance speed of the recording material in at least a part of an image capturing period during which the image capturing device captures the surface images a plurality of times, the image capturing device being configured to capture the surface image not depending on the conveyance speed of the recording material, wherein the image forming apparatus obtains feature quantity data on the basis of data obtained from the captured surface images, wherein the feature quantity data reflects a feature of the recording material, and wherein the controller corrects the obtained feature quantity data based on the conveyance speeds of the recording material during the image capturing period, and controls the image forming condition based on the corrected feature quantity data.

15. The image forming apparatus according to claim 14, wherein the controller further corrects the corrected feature quantity data based on the number of times the image capturing device captures the surface image and controls the image forming condition based on the further corrected feature quantity data and a threshold value.

16. The image forming apparatus according to claim 14, wherein, in each of the plurality of surface images captured by the image capturing device, a plurality of pixels exists in each of a first column and a second column parallel to a conveyance direction of a recording material, and wherein the controller unit obtains the feature quantity data by integrating an amount of change of output values of the plurality of pixels arranged in the first column and an amount of change of output values of the plurality of pixels arranged in the second column.

17. The image forming apparatus according to claim 16, wherein, in the plurality of surface images captured by the image capturing device, a plurality of pixels exists in a predetermined column parallel to the conveyance direction of the recording material, and wherein, with respect to all of the pixels existing in the predetermined column, the controller obtains an amount of change of output values of the plurality of pixels by obtaining and integrating an absolute value of a difference of output values of two pixels adjacent to one another in the conveyance direction of the recording material.

18. The image forming apparatus according to claim 14, wherein the image formation device includes a transfer device that transfers an image onto the recording material, and wherein, in a case where the mechanical conveying device stops the recording material at a predetermined position on an upstream side of the transfer device in a conveyance direction of the recording material, to allow the controller to control the image forming condition with respect to the recording material after the surface images of the recording material are captured by the image capturing device, the mechanical conveying device decelerates a conveyance speed of the recording material in at least a part of the image capturing period to stop the recording material at the predetermined position.

19. The image forming apparatus according to claim 18, wherein, in a case where an image is formed on a first recording material by the image formation device, the mechanical conveying device stops the recording material at the predetermined position.

20. The image forming apparatus according to claim 18 further comprising a non-transitory storage that stores an average conveyance speed of the recording material in the image capturing period, wherein the controller further corrects the corrected feature quantity data based on an average conveyance speed of the recording material stored in the storage and controls the image forming condition based on the further corrected feature quantity data and a threshold value.

21. The image forming apparatus according to claim 14 further comprising a sensor configured to detect a recording material on an upstream side of the image formation device in the conveyance direction of the recording material, wherein the image formation device includes a transfer device that transfers an image onto the recording material, and wherein, in a case where the mechanical conveying device accelerates or decelerates a conveyance speed of the recording material without stopping the recording material to allow the transfer device to transfer the image onto the recording material based on a timing at which the recording material is detected by the sensor, the mechanical conveying device accelerates or decelerates the conveyance speed of the recording material in at least a part of the image capturing period.

22. The image forming apparatus according to claim 21, wherein, in a case where an image is formed on a second recording material by the image formation device, the mechanical conveying device accelerates or decelerates conveyance speeds of the second recording material without stopping the second recording material.

23. The image forming apparatus according to claim 21, wherein the controller obtains the average conveyance speed of a recording material in the image capturing period based on the timing at which the recording material is detected by the sensor, further corrects the corrected feature quantity data based on the average conveyance speed of the recording material, and controls the image forming condition based on the corrected feature quantity data and a preset threshold value.

24. The image forming apparatus according to claim 14, wherein, in the image capturing period, the radiation source does not change an amount of light radiated to the recording material, and the image capturing device does not change a light receiving period, which is a period for capturing the surface image, for receiving and capturing light reflected on the recording material.

25. The image forming apparatus according to claim 14, wherein the image capturing device is a line sensor including a plurality of light receiving elements arranged in a direction parallel to a conveyance surface of a recording material and orthogonal to a conveyance direction of the recording material.

26. The image forming apparatus according to claim 14, wherein the image forming condition is a conveyance speed of a recording material, a voltage value applied to a transfer device included in the image formation device, or a temperature at which a fixing device included in the image formation device fixes an image on a recording material.

* * * * *